US005246365A

United States Patent [19]

Himmel et al.

[11] Patent Number: 5,246,365

[45] Date of Patent: Sep. 21, 1993

[54] REIGNITION DEVICE FOR A GAS BURNER

[75] Inventors: Robert L. Himmel, Cleveland; Richard A. Erhard, Medina, both of Ohio

[73] Assignee: Maytag Corporation, Newton, Iowa

[21] Appl. No.: 850,803

[22] Filed: Mar. 13, 1992

[51] Int. Cl.[5] ..... F23Q 3/00

[52] U.S. Cl. ..... 431/263; 431/349; 126/39 H

[58] Field of Search ..... 431/266, 349, 263; 126/39 H, 39 K, 39 R

[56] References Cited

U.S. PATENT DOCUMENTS

| | | |
|---|---|---|
| 3,219,098 | 2/1963 | Fulmer . |
| 3,260,300 | 4/1960 | Lannert et al. . |
| 3,358,736 | 7/1965 | Reed et al. . |
| 3,627,462 | 12/1971 | Lotter . |
| 3,632,040 | 1/1972 | de Gouville . |
| 3,796,535 | 3/1974 | De Gouville . |
| 3,825,404 | 7/1974 | De Gouville . |
| 4,541,407 | 9/1985 | Sommers et al. . |
| 4,604,048 | 8/1986 | Schwartz et al. . |
| 4,690,636 | 9/1987 | De Gouville et al. . |
| 4,757,801 | 7/1988 | De Gouville et al. . |
| 4,773,383 | 9/1988 | De Gouville et al. . |
| 4,891,006 | 1/1990 | De Gouville et al. . |
| 4,953,534 | 9/1990 | De Gouville et al. . |
| 4,968,246 | 11/1990 | Sasada et al. . |
| 5,133,658 | 7/1992 | De Gouville et al. ..... 431/349 |

FOREIGN PATENT DOCUMENTS

| | | | |
|---|---|---|---|
| 1543618 | 4/1979 | United Kingdom | 431/266 |

*Primary Examiner*—Larry Jones

*Attorney, Agent, or Firm*—Bacon & Thomas

[57] ABSTRACT

A reignition device for a gas burner includes a reignition flame chamber which opens into a burner face of the gas burner. The burner face is also provided with a plurality of circumferentially spaced burner ports. The reignition chamber includes at least one port for receiving an air/gas mixture flowing within the burner head. A reignition flame is initially ignited at the reignition chamber by a burner port flame or an electrode which also can be used to ignite the gas flowing out of the various burner ports in the burner face. The reignition device is designed so that the reignition flame burns in a balanced and stable manner both when the burner is set at a high rate and when the gas burner is turned down to a low setting. Subsequently, should the flames about the burner face be extinguished by an external influence, the reignition flame will remain ignited and will function to reignite the burner flames.

16 Claims, 3 Drawing Sheets

REIGNITION DEVICE FOR A GAS BURNER

BACKGROUND OF THE INVENTION

1. Field of the Invention

The present invention generally involves the field of technology pertaining to gas burners. More specifically, the invention relates to an improved reignition device for use with gas burners, particularly sealed gas burners capable of a low turndown rate and having spark ignitors.

2. Description of the Prior Art

In general, range top burners are either of the open or sealed type. Range top burners which are open to secondary air for combustion typically have turndown rates to approximately 1,200–2,000 BTU/hr to maintain foods at a "warm" setting. In a sealed burner assembly, where the secondary air is drawn through a gap formed between the range top and the bottom of the pan or utensil resting on the grate above the burner head, a turndown rate of approximately 1,800–2,000 BTU/hr typically may be maintained.

For certain cooking operations, such as melting chocolate or preparing delicate sauces, it is desirable to turn down the input burner rate to approximately 900 BTU/hr. At these minimum input rates, the small flames about the burner face can be easily extinguished by various external influences such as slamming the oven door, setting a pot on the grates and drafts. Therefore, in order to operate a burner at such low input rates, a reignition feature must be provided.

It is hereto before been known in gas burner assemblies to provide a pilot flame, remote from the burner head, which remains ignited even when the gas to the burner head is turned off. In these known arrangements, when the gas applied to the burner head is turned on, the burner head flames are ignited by the pilot light flame. Since maintaining a constant pilot light is uneconomical burner arrangements with electronic ignition systems have been used instead. Such known systems operate to provide a spark either within the burner head or at the burner face in order to ignite the gas supplied to the burner. Although the spark ignition arrangements alleviate the need for a constantly burning pilot flame, they operate dependably only at the higher turndown rates discussed above.

One possible solution to this problem of providing a lower turndown rate while assuring reignition of the burner flames if extinguished would be to use an electronic flame monitoring system, in connection with a known spark ignition arrangement, which would sense the absence of a flame and cause a spark to be produced to reignite the burner. Unfortunately, this type of arrangement would involve costly electronic components. Therefore, there exists a need for a reignition device for a gas burner operating at low turndown rates which can economically and efficiently reignite the burner flames when these flames are extinguished by means other than the burner control system, i.e., an external influence.

SUMMARY OF THE INVENTION

It is an object of the present invention to provide an improved gas burner assembly that can operate at low turndown rates.

It is another object of the present invention to provide a reignition device for a gas burner capable of operating at a low turndown rate which can reignite the burner flames when extinguished by an external influence (i.e., other than the burner control).

It is still a further object of the invention to provide a reignition assembly for a gas burner which is extremely simple in construction and economical to manufacture.

The foregoing and other objects of the invention are realized by providing a gas burner that includes a burner head formed from a burner cap and a burner base. The burner cap is formed with a reignition chamber which includes at least one port for receiving a gas/air mixture flowing within the burner head and which opens up into a burner face provided with a plurality of spaced burner ports. A reignition flame is initially ignited at the reignition chamber by an ignitor which ignites the gas flowing out of the various burner ports in the burner face. Subsequently, should the flames about the burner face be extinguished by an external influence, the reignition flame will remain ignited and will function to reignite the main burner.

Other objects, features and advantages of the invention will become apparent from the following detailed description of a preferred embodiment thereof, when taken in conjunction with the drawings wherein like reference numerals refer to corresponding parts in the several views.

DETAILED DESCRIPTION OF THE PREFERRED EMBODIMENTS

Figure 1:
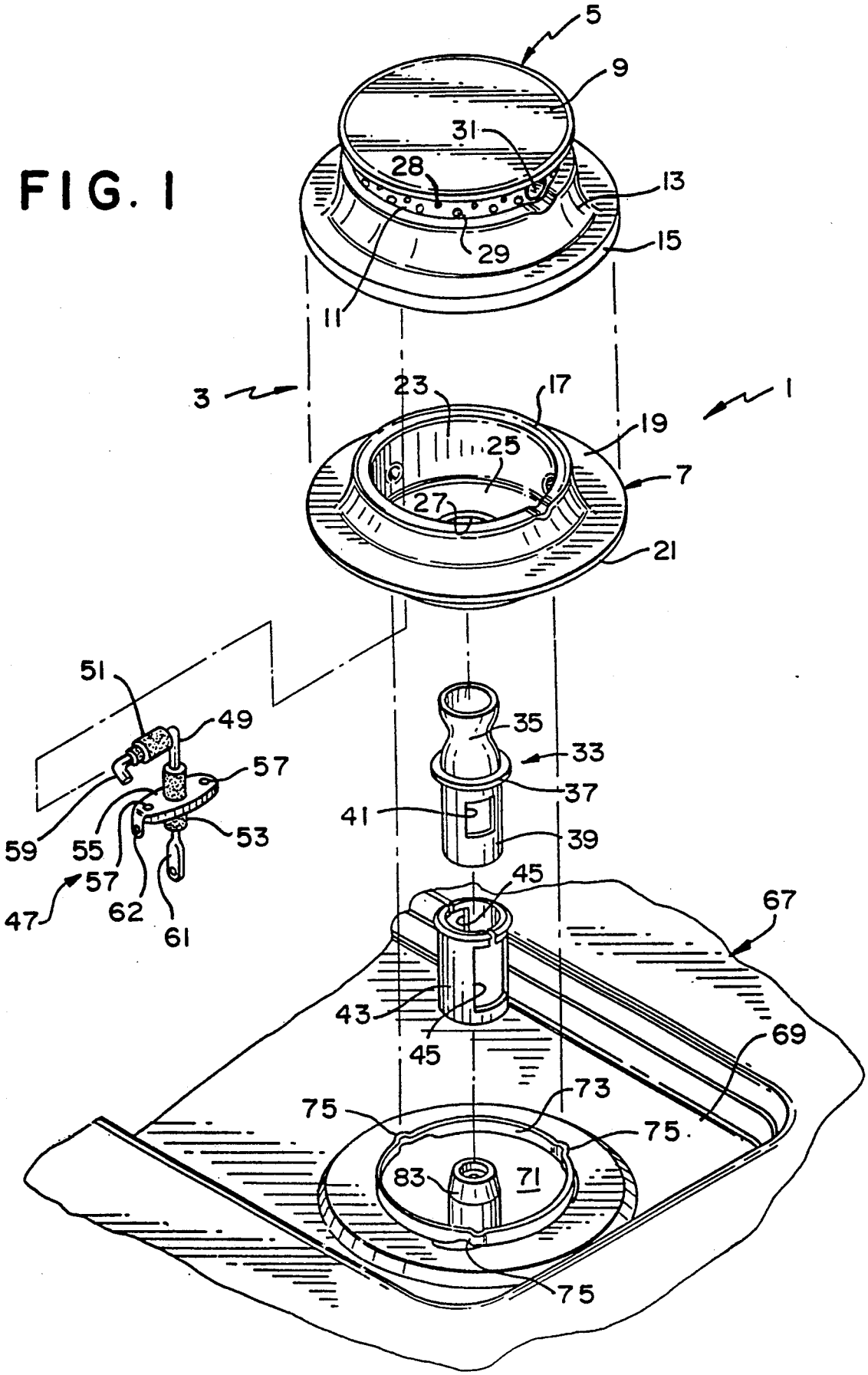
FIG. 1 is an exploded perspective view of a gas burner assembly incorporating the reignition device of the invention.

A reignition device according to a preferred embodiment of the present invention will now be described in connection with a sealed gas burner assembly generally indicated at 1 with initial reference to FIGS. 1–3. As seen in FIG. 1, burner assembly 1 includes a burner head 3 comprised of a burner cap 5 and a burner base 7. Cap 5 and base 7 are each preferably formed from drawn or stamped sheet metal. Cap 5 is of a generally circular configuration and includes a flat top 9, a vertical sidewall 11 extending downwardly from top 9, and a curved sidewall 13 that extends downwardly and outwardly from sidewall 11. The outer circumferential edge of sidewall 13 is defined by a downwardly extending circular flange 15.

Burner base 7 is also of a generally circular configuration and is defined by an upper annular rim 17 from which a curved sidewall 19 extends downwardly and outwardly, and terminates in a circumferential edge 21. An inner cylindrical wall 23 extends downwardly from rim 17 and terminates in a circular bottom wall 25 which is provided with a central circular aperture 27 therethrough. The configuration of curved sidewall 19 corresponds to the configuration of curved sidewall 13 so that base 19 may be received within cap 5 and secured thereto by deforming flange 15 of cap 5 inwardly around edge 21 of base 7.

As further seen in FIG. 1, vertical sidewall 11 of cap 5 is also provided with a plurality of burner ports 28, 29 formed therein and circumferentially spaced therearound in a manner and for a purpose to be later detailed. Sidewall 11 also includes an aperture 30 for an ignitor electrode (see FIG. 2) and a reignition device aperture 31, the details of which will be further described herein. In the embodiment shown, electrode aperture 30 and the reignition device aperture 31 are located 180° apart about the periphery of sidewall 11, however, this positioning is not critical to the invention. Fixedly secured to sidewall 11 within aperture 31 is the reignition device of the present invention, generally indicated at 32 (see FIG. 2) and which will be more fully discussed below. With this arrangement, when base 7 is secured to cap 5 by crimping flange 15 around edge 21, an internal chamber of substantially cylindrical configuration is defined therebetween.

As also seen in FIG. 1, there is provided a venturi member 33 which includes a venturi tube 35, an annular ring 37 and a cylindrical tube 39 extending downwardly from ring 37. Tube 39 is provided with a pair of opposed apertures 41 and a cylindrical air shutter 43 which is rotatably and concentrically received on tube 39. Shutter 43 is also provided with a pair of corresponding opposed apertures 45 which are variably alignable with apertures 41 to provide the desired air intake for member 33. As is apparent for FIGS. 1 and 2, member 33 is assembled to burner head 3 by inserting venturi tube 35 through aperture 27 of burner base 7 until tube 35 is fully received and enclosed within the internal chamber of head 3. In this position, annular ring 37 abuts the exterior surface of bottom 25 adjacent the peripheral edge of aperture 27. Member 33 is secured to base 7 through staking or crimping in a manner to be later described.

Burner assembly 1 also includes an electrode 47 that is defined by an electrical wire 49, a first cylindrical electrically insulative support member 51 and a second cylindrical electrically insulative support member 53, the latter being secured through a mounting bracket 55 to burner base 7 as will be discussed below. Wire 49 terminates at one end in a turned portion 59 and at the other end in a terminal blade 61 of appropriate configuration for electrical connection to a conventional ignition circuit. As also shown in FIG. 1, mounting bracket 55 includes a wire connection 62 for the ignition circuit. As seen in FIG. 2, electrode 47 is inserted through an aperture 63 formed in bottom wall 25 of base 7 and secured thereto through bracket 55 by any means known in the art. End portion 59 of electrode 47 is inserted through electrode aperture 31 of cap 5 and extends across sidewall 11 closely adjacent to one of the burner ports 29. In this assembled configuration, terminal blade 61 and a portion of second insulative member 53 extends downwardly from bracket 55, the latter being disposed against the exterior of bottom wall 25.

Figure 2:
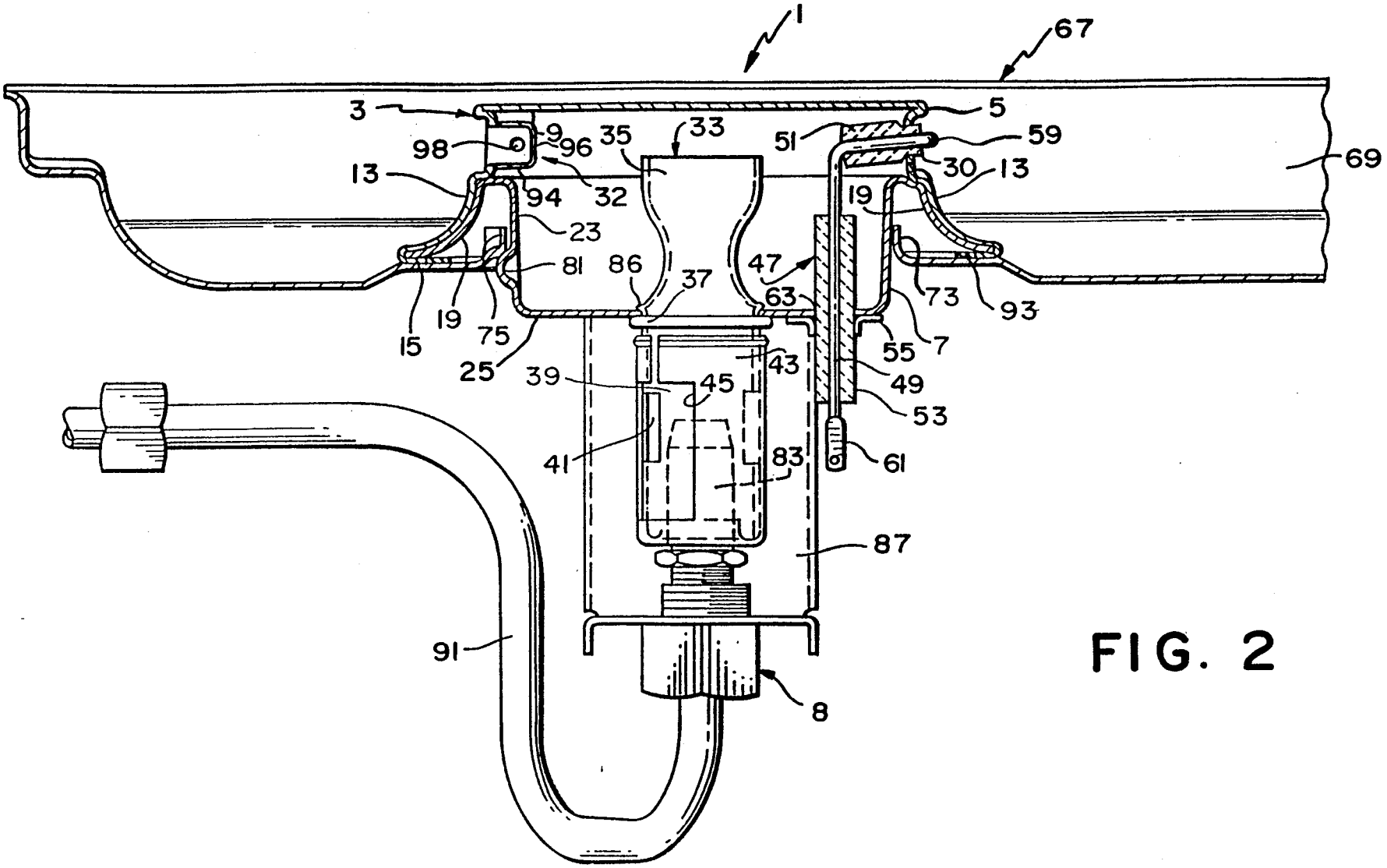
FIG. 2 is a cross sectional view of the gas burner assembly of FIG. 1 secured within a burner opening of a range top.
Figure 3:
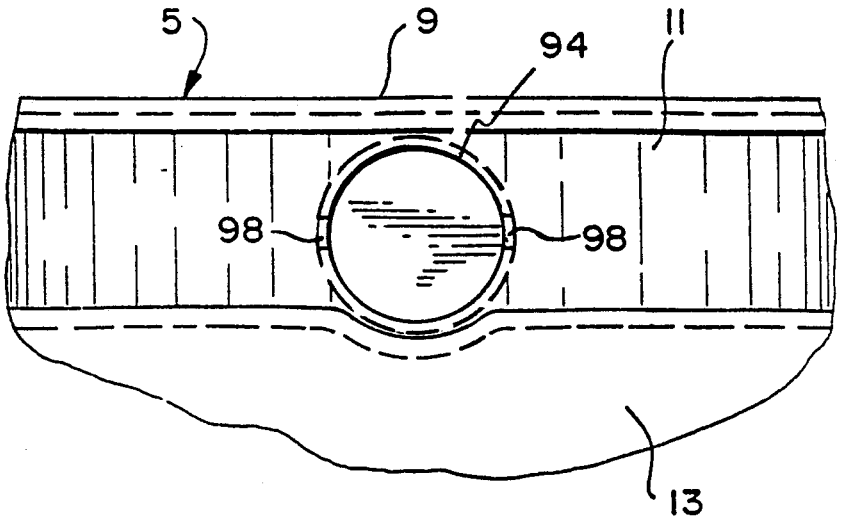
FIG. 3 is a partial front elevational view showing the reignition device installed within the burner head of the assembly.

When burner head 3, venturi member 33 and electrode 47 are assembled in the manner described, they collectively form gas burner assembly 1 which may in turn be sealably secured to a range top 67 as shown in FIG. 2. Top 67 includes a recessed burner well 69 provided with a burner opening that is defined by a circular vertical flange 73. In the preferred embodiment, a plurality of outwardly extending L-shaped protuberances 75 are formed in flange 73 and equally spaced therearound. Each protuberance 75 cooperates with one of a plurality of corresponding outwardly extending protuberances 81 are formed in cylindrical wall 23 of burner base 7 for securing burner base 7 within burner well 69. Since this particular connection is not part of the present invention, it will not be further described in detail and it should be realized that various other attachment means could be used without departing from the spirit of the present invention. When assembly 1 is secured to top 67 in this manner, a gas inlet nozzle 83 supported in a burner box (not shown) below top 67 is received within cylindrical tube 39 of venturi member 33 for the purpose of supplying gas thereto.

As also evident in FIG. 2, venturi tube 35 of member 33 is fully contained within the internal chamber of head 3, with member 33 being securely attached to bottom wall 25 through crimping or staking, as indicated at 86. A U-shaped bracket 87 is used to support a conventional gas inlet fitting 89 to which gas inlet nozzle 83 is secured. Fitting 89 receives gas from a gas line 91 which is connected to an appropriate gas source (not shown).

Specific reference will now be made to FIGS. 2 and 3 in describing in more detail the reignition device 32 of the present invention. Reignition device 32 includes a substantially cylindrical main body portion 94 having an exterior end which opens into aperture 31 and a closed interior end 96 thereby defining a flame chamber or cup (not labeled). Main body portion 94 is formed with at least one reignition port 98 therein which opens into the interior of burner head 3 such that an air/gas mixture flowing through venturi tube 35 will flow through both burner ports 28, 29 and reignition port 98. In the preferred embodiment as shown in FIG. 3, two such ports 98, located 180° apart about the periphery of main body portion 94, are provided. By this arrangement, when electrode 47 produces a spark, a reignition flame will be ignited at reignition device 32 along with the ignition of the gas flowing out of ports 28, 29 as discussed more fully below.

When sealed burner assembly 1 is used for cooking, an appropriate grate (not shown) is supported on rangetop 67 over well 69 and directly above burner head 3. This serves to support the cooking utensil in a spaced manner above top 9 of burner head 3 and thereby permit the flow of secondary air between the bottom of the cooking utensil and well 69. The primary air/gas mixture is received through venturi tube 35 into the internal chamber of burner head 3 for distribution outwardly through burner ports 28, 29 and ports 98 formed in the reignition device 32. Rotation of air shutter 43 relative to cylindrical tube 39 of member 33 permits the establishment of the desired proportions of primary air and gas fed to tube 35. In the event that the flames about the periphery of burner head 3 (i.e. at burner ports 28, 29) become extinguished, for example when burner assembly 1 is operating at a low burning rate, (e.g. 900 BTU/hr), due to an external draft or an internal breeze (perhaps caused by slamming of the oven door) blowing out the flames, the flame at the reignition device 32 will still remain lit and will function to reignite the burner. The flame at the reignition device 32 remains lit under these conditions mainly due to the hole configuration and size and will reignite the burner due to the positioning of reignition device 32 relative to ports 28, 29 as discussed below.

As also evident from FIG. 1, burner ports 28, 29 are preferably circular in configuration and arranged in two sets including an upper row of uniform smaller diameter ports 28 and a lower row of uniform larger diameter ports 29 which are circumferentially spaced around vertical sidewall 11 in an alternating manner. The configuration and arrangement of burner ports 28, 29, taken in conjunction with the previously described unique features of assembly 1, also contribute significantly to the reduced burner rate and reignition feature now made possible by the present invention. Ports 98 in reignition device 32 range in size from a #55 DMS to a #19 DMS with natural gas and #55 DMS to #35 DMS with propane gas. In a preferred embodiment, ports 98 are sized to a #52 DMS. It has been found that these sizes may vary while maintaining an area ratio of the reignition device aperture 31 to reignition ports 98 within the range of 19.69 to 1.93 with natural gas and 19.58 to 4.37 with propane gas. With initial testing, the best results were obtained with ratio ranges of 19.69 to 10.84 and 19.58 to 10.78 respectively. Furthermore, the size of burner ports 28, 29 can also vary along with their relative spacing. In the preferred embodiment shown, #54 DMS ports 28 and #45 DMS ports 29 are provided. With these preferred sizes for ports 28, 29 and 98, the area of reignition device aperture 31 is within the range of approximately 13 to 52 times that of one of ports 28 and 29 or, more specifically, approximately 13 to 52.45 for natural gas and 12.9 to 52 for propane. It should also be recognized that the positioning of ports 28, 29 may be reversed, however it has been found that reignition occurs best with larger ports 29 located adjacent to aperture 31 (approximately 0.125 inch spacing in the preferred arrangement) since the larger aperture creates a flatter and broader flame configuration.

With this construction, the combined gas flow provided by the opposed #52 DMS ports 98 within reignition device 32 is equal to or greater than the flow through one of the burner ports 28 and 29. The flow velocity at reignition device aperture 31, however, is much less than at any of the burner ports due to the opposed flow and due to the greater area. This lower flow velocity allows the reignition flame to burn, close to the burner face similar to a burner port, at the full input rate of 9,000–12,000 BTU/hr. When at a low burner input rate of approximately 900 BTU/hr., the flames at the burner ports are small and somewhat cone shaped but the flame at the face of the reignition device 32 is flat, with the flame being located slightly within the face of the reignition feature. Also, the flame is somewhat quenched which reduces the burning velocity. This attribute, combined with the opposed ports 98 and reduced flow velocity, balances the flow and burning velocities, thus preventing flame blowout or flashback. For this reason, even though the flames about the burner face may be extinguished by an external influence, the flame at the reignition device 32 will remain ignited. Furthermore, in the event that the flames about the burner face are extinguished, they will be reignited by the flame at reignition device 32 due to the proximity of burner ports 29 to aperture 31.

In the present invention, the terminal blades 61 and 62 of electrode 47 may be connected to any appropriate known ignition circuit, such as that disclosed by the Stohrer, Jr. U.S. Pat. No. 4,626,196, the entire disclosure of which patent is incorporated herein by reference. Furthermore, the individual components of burner assembly 1 may be formed from any suitable material known in the art and deemed appropriate for the practice of the invention as disclosed herein. Such suitable materials are disclosed by the Kwiatek U.S. Pat. No. 4,810,188 and Kwiatek U.S. Pat. No. 4,846,671, the full disclosures of which patents are also incorporated herein by reference.

Although the present invention has been described herein with regard to details of the preferred embodiments thereof, it shall be understood that changes in form, size, shape, composition and arrangement of parts may be made by one of ordinary skill in the art without departing from the invention. For instance, although the reignition device of the present invention is shown incorporated in a sealed burner assembly, the invention may also be effectively used in a non-sealed arrangement. In addition, although the electrode is depicted as being located on an opposite side of the cap from the reignition device so as to ignite the burner ports first, the electrode could instead be located adjacent the reignition chamber which would result in the ignition of the air/fuel mixture at the reignition device first. In general, the invention is only intended to be limited by the spirit and scope of the following claims.

We claim:

1. In a gas burner including a burner head with a sidewall provided with a plurality of burner ports and means for supplying an air/gas mixture to the burner ports, the improvement comprising a reignition device including a main body portion secured to said burner head and having first and second ends defining a reignition chamber therebetween, at least one of said ends defining a reignition aperture opening into said sidewall adjacent at least one of said burner ports, said main body portion including at least two ports through which a portion of said air/gas mixture can flow into the reignition chamber such that, upon ignition of said air/gas mixture, burner flames are produced at the burner ports along with a reignition flame at said reignition chamber, the reignition flame being adapted to reignite the air/gas mixture flowing through said burner ports in the event said burner flames are extinguished by an external influence, the area ratio of said reignition aperture to said ports formed in said main body portion is within the range of 19.69 to 10.84 with natural gas and 19.58 to 10.78 with propane gas while the area of said reignition aperture is within the range of 13 to 52 times that of one of said burner ports.

2. The gas burner of claim 1, wherein said main body portion is mounted substantially entirely within said burner head.

3. The gas burner of claim 1, wherein said main body portion is provided with two opposing ports.

4. The gas burner of claim 3, wherein said main body portion is substantially cylindrical in shape and said two ports are located 180° apart about the periphery of said cylindrical main body portion.

5. The gas burner of claim 3, wherein said two opposing ports range in size from a #55 DMS to a #19 DMS with natural gas and #55 DMS to #35 DMS with propane.

6. The gas burner of claim 5, wherein said two opposing ports are sized to a #52 DMS.

7. The gas burner of claim 5, wherein said plurality of burner ports includes a series of circumferentially spaced upper holes and a series of circumferentially spaced lower holes with said lower holes being sized larger than said upper holes.

8. The gas burner of claim 7, wherein said lower holes are sized to a #45 DMS and said upper holes are sized to a #54 DMS.

9. The gas burner of claim 8, wherein said two opposing ports are sized to a #52 DMS.

10. The gas burner of claim 1, wherein said first end of said main body portion opens into said sidewall and said second end is closed.

11. The gas burner of claim 1, further including an igniting means for igniting the burner, said igniting means comprising a spark producing electrode housed within said burner head and having a terminal end portion which extends through said sidewall and terminates adjacent one of said reignition device and said plurality of burner ports.

12. A reignition device for use on a gas burner of the type including an electrically conductive burner cap having a sidewall provided with a plurality of burner ports and an electrode aperture, means for supplying an air/gas mixture to the burner ports, an electrically insulative support member mounted on the electrode aperture and provided with an electrode passageway therethrough, a spark electrode extending through the electrode passageway and completely surrounded by the support member, and a spark electrode having a terminal end portion disposed exteriorly of the support member adjacent at least one of the plurality of burner ports for igniting the air/gas mixture into flames, said reignition device comprising:

reignition chamber means fixedly secured to said burner cap, said plurality of burner ports including a series of circumferentially spaced upper holes and a series of circumferentially spaced lower holes with said lower holes being sized larger than said upper holes, said reignition chamber opening into said sidewall directly adjacent at least one of said lower holes; and means for permitting an air/gas mixture to enter said chamber means such that the air/gas mixture flows from the reignition chamber at a lower velocity than at the burner ports so that it burns at a balanced and stable rate at both full and reduced burner input rates whereby, should the flames at the burner ports become extinguished by an external influence, said reignition device will remain ignited and will function to reignite the flames at the burner ports.

13. The reignition device of claim 12, wherein said chamber means opens into said sidewall between two of said lower holes.

14. The reignition device of claim 12, wherein said means for permitting an air/gas mixture to enter said chamber means comprises at least one port formed in said chamber means.

15. The reignition device of claim 14, wherein two ports are formed in said chamber means for the introduction of said air/gas mixture.

16. The reignition device of claim 12, wherein said two holes are located opposite to each other.

* * * * *